US006227687B1

(12) United States Patent
Kahwaji

(10) Patent No.: US 6,227,687 B1
(45) Date of Patent: May 8, 2001

(54) INTERLEAVED ILLUMINATION SUPPORT

(76) Inventor: Michael A. Kahwaji, 3401 Madera Ave., Los Angeles, CA (US) 90039

( * ) Notice: Subject to any disclaimer, the term of this patent is extended or adjusted under 35 U.S.C. 154(b) by 0 days.

(21) Appl. No.: 09/419,280

(22) Filed: Oct. 15, 1999

(51) Int. Cl.[7] ..... F21V 17/00; F21V 21/008

(52) U.S. Cl. ..... 362/391; 362/248; 362/361; 362/410; 362/433

(58) Field of Search ..... 362/122, 237, 362/248, 249, 250, 252, 360, 361, 391, 410, 433, 441

(56) References Cited

U.S. PATENT DOCUMENTS

| | | | | |
|---|---|---|---|---|
| 860,406 | * | 7/1907 | McGahan | 362/410 |
| 1,371,936 | * | 3/1921 | Rubino | 362/410 |
| 1,881,424 | * | 10/1932 | Favreau | 362/410 |
| 2,566,672 | * | 9/1951 | Nave et al. | 362/410 |
| 2,744,192 | * | 5/1956 | Rosenthal | 362/360 |
| 2,841,696 | * | 7/1958 | Herrey | 362/361 |
| 2,853,598 | * | 9/1958 | Balthauser | 362/410 |
| 4,234,915 | * | 11/1980 | Malinowski et al. | 362/391 |
| 4,789,572 | * | 12/1988 | Weaver | 362/122 |
| 5,899,555 | * | 5/1999 | Lin | 362/122 |

* cited by examiner

*Primary Examiner*—Alan Cariaso

(57) ABSTRACT

The invention relates to an interleaved illumination support. The support includes a base and a wire coupled to the base. The wire includes beads attached to the wire along the length of the wire. A first leaf is coupled between the base and a bead that is the second bead above the base so as to maintain the wire in tension. A second leaf is coupled between a first bead and a fourth bead so as to maintain the wire in tension. A light source is coupled to the wire. Other features are disclosed.

14 Claims, 2 Drawing Sheets

INTERLEAVED ILLUMINATION SUPPORT

BACKGROUND OF THE INVENTION

1. Field of the Invention

The present invention relates generally to illumination, and more particularly to support of light sources for lamps.

2. Background Information

A lamp is generally viewed as a piece of furniture holding one or more electric light bulbs. The electric light bulbs operate as an artificial source of visible illumination. Most table lamps vertically support light sources by employing a vase having a light bulb in a socket and a harp that supports a lamp shade about the light bulb. Other types of lamps such as floor lamps employ a pole or post having adjustable ball and socket light supports attached to the pole. The benefit of such table or floor lamps is that they may be quickly located and installed in one place or another. The problem with such lamps is that the vertical height of each light source on the lamp is fixed by the manufacturer.

Some light sources are supported by line-wire or cable. For example, holiday lights include a series of light bulbs coupled to a flexible wire that is horizontally strung to the eaves of a roof. This allows a user to adjust the vertical height of each light source on the lamp. For example, the string of lights may be suspended from the ceiling of a home. The benefit of flexible line-wire lamps is that the vertical position of each light source may be controlled by the consumer. However, line-wire lamps lack the locational flexibility of table and floor lamps. Thus, what is needed are light sources that include the locational flexibility of table and floor lamps as well as the vertical height adjustibility of line-wire lamps.

BRIEF SUMMARY OF THE INVENTION

The invention relates to an interleaved illumination support. The support includes a base and a wire coupled to the base. The wire includes beads attached to the wire along the length of the wire. A first leaf is coupled between the base and a bead that is the second bead above the base so as to maintain the wire in tension. A second leaf is coupled between a first bead and a fourth bead so as to maintain the wire in tension. A light source is coupled to the wire. Other features are disclosed.

DETAILED DESCRIPTION OF THE INVENTION

For purposes of explanation, specific embodiments are set forth to provide a thorough understanding of the present invention. However, it will be understood by one skilled in the art from reading this disclosure that the invention may be practiced without these details. Moreover, well-known elements, devices, process steps and the like are not set forth in detail in order to avoid obscuring the invention.

Figure 1:
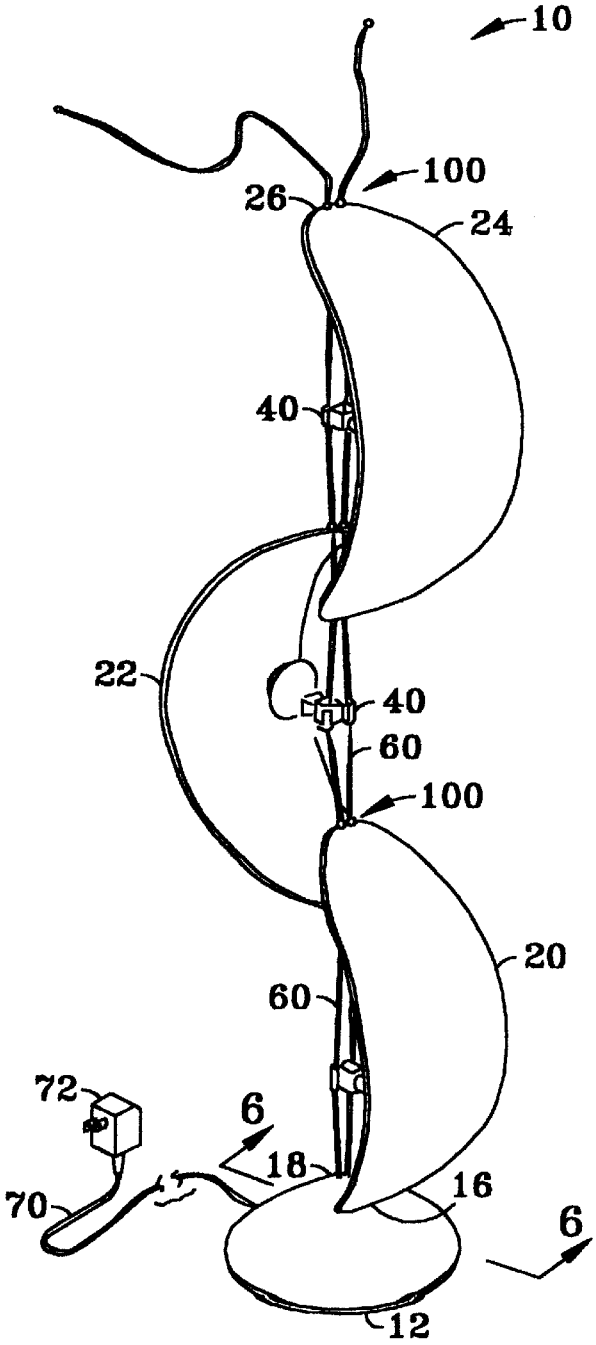
FIG. 1 is an isometric view of an embodiment of lamp 10.
Figure 2:
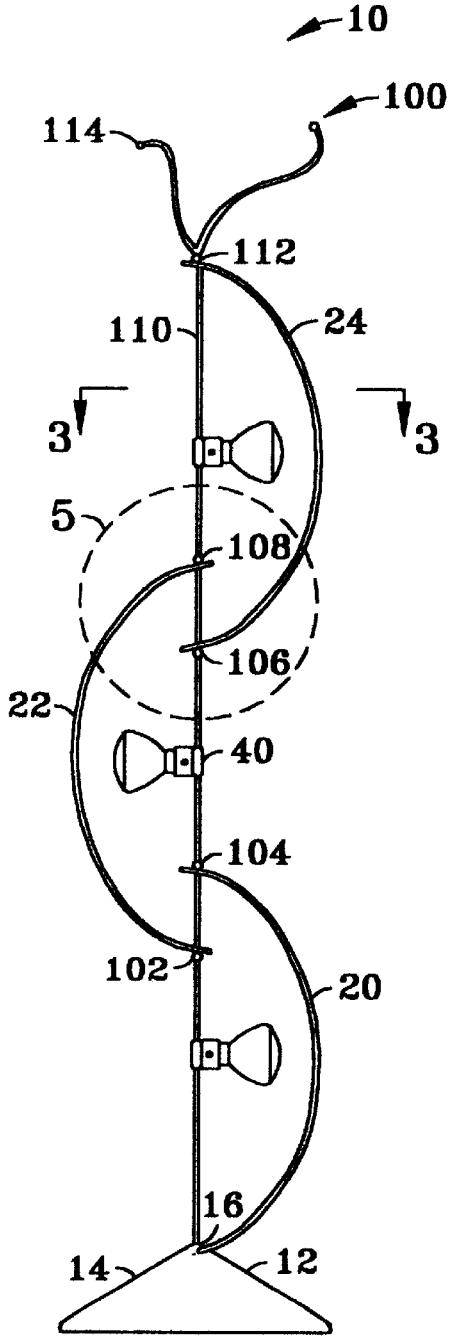
FIG. 2 is a side view of lamp 10 of FIG. 1.

Reference is now made to FIGS. 1 through 6 to illustrate the embodiments of the invention. FIG. 1 is an isometric view of an embodiment of lamp 10. FIG. 2 is a side view of lamp 10 of FIG. 1. Included with lamp 10 is base 12, leaf 20, light source 40, wire 60, power cord 70, and plug 72.

Figure 6:
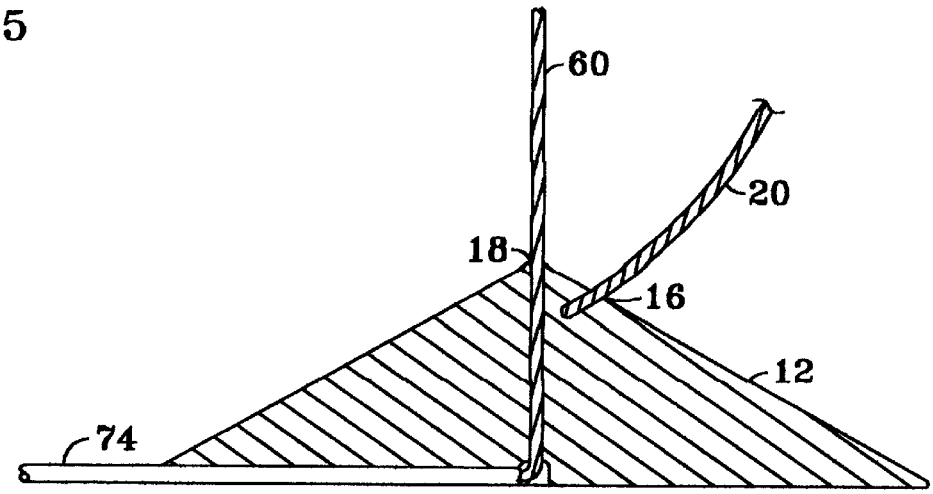
FIG. 6 is a detailed view of vase 12 showing leaf 20 placed into cutout 16 as taken off of line 6—6 of FIG. 1.

Base 12 preferably is composed of cone 14 that extends to flat bottom 16. Base 12 includes cutout 16 and aperture 18 as best seen in FIG. 6. However, base 12 may be any structure that permits lamp 10 to stand on its own, that serves to anchor wire 60 and leaf 20 as discussed below.

Figure 4:
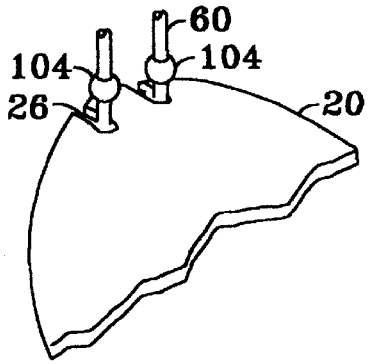
FIG. 4 illustrates leaf 20 disposed below beads 104.

Leaf 20 preferably is an oblong shaped piece of resilient plastic into which slots 26 are cut into each end as best seen in FIG. 4. In one embodiment, leaf 20 measures 12×4×0.125 inches and is used as a light deflector. Additional leaves, such as leaf 22 and leaf 24 may be added to lamp 10 as discussed below.

Figure 3:
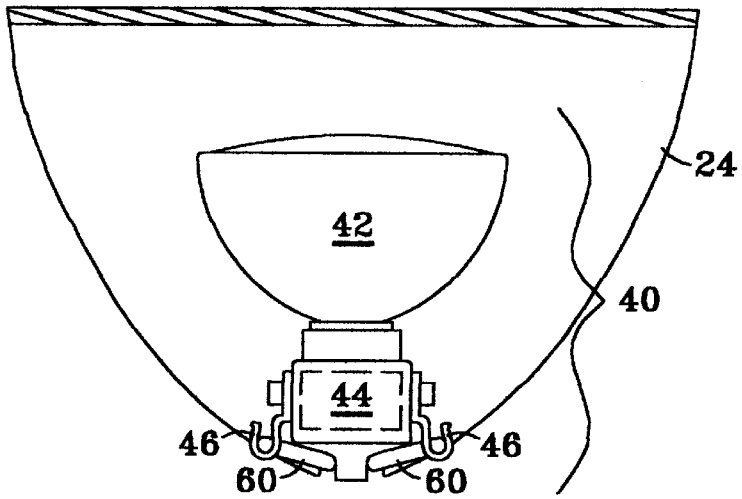
FIG. 3 is a plan view of light source 40 taken off of line 3—3 of FIG. 2.
Figure 5:
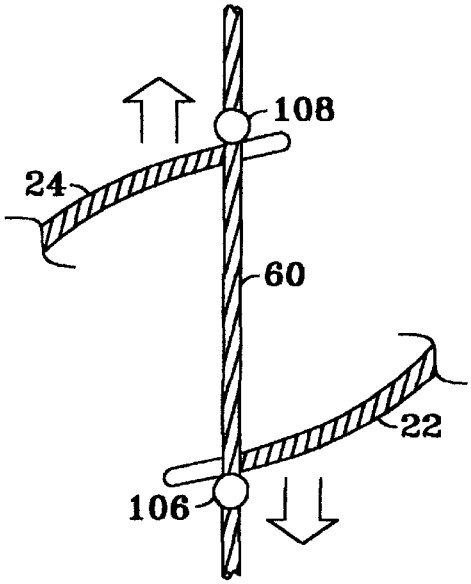
FIG. 5 is a detailed view of the tension of wire 60 between two leaves as taken off of line 5 of FIG. 2.

Light source 40 preferably is a light source that is clipped on to wires 60. FIG. 3 is a plan view of light source 40 taken off of line 3—3 of FIG. 2. Included with light source 40 may be bulb 42 coupled to housing 44. So as to be able to clip light source 40 to two wires 60, light source 40 further includes two terminals 46. Each terminal 46 may have an opening that is narrower than the diameter of wire 60, but is made of a resilient conductive material that works to return to its original position once wires 60 are snapped into place. Alternatively, the distance between each of the two terminals 46 is slightly greater or less than the distance between each of the two wires 60.

Wire 60 may be any conductive material the is elongated. Preferably, wire 60 is made of flexible, twenty four gauge picture frame wire. At one end, wire 60 is coupled to a power source. This may be through power cord 70 and plug 72 as shown in FIG. 1. Plug 72 preferably is a low voltage transformer that steps down a conventional one hundred twenty volt power supply to twelve volts. Light source 40 may be self powered such as including a battery. An insulating sleeve 74 may be placed around each wire 60 as shown in FIG. 6. Preferably two wires 60 are provided so as to be able to use clip-on light source 40. Where light source is coupled to power cord 70, power is distributed to light source 40 through two wires 60.

Attached along wire 60 is beads 100. Beads 100 include the group of beads attached to wire 60. Beads 100 may be solder drop welds or any other material that is fixed to wire 60 so as to retain the leaves of lamp 10 under compression. For example, beads 100 may be nuts screwed onto wire 60 or fishing weights clamped about wire 60. As best seen in FIG. 2, leaf 24 is retained under compression by beads 106 and beads 112. So as to be able to retain leaves 20, 22, and 24 against wire 60 and to maintain a vertical stacking of leaves 20, 22, and 24, the spacing between beads 100 needs to be considered.

In one embodiment of the invention, such as that shown in FIG. 2, beads 100 include a multitude of beads attached to wire 60. Beads 104 may be attached at two inches from bead 102. Beads 106 may be attached at seven inches from bead 104. Beads 108 may be attached at two inches from bead 106. Beads 110 may be attached at seven inches from bead 108. Beads 112 may be attached at two inches from bead 110, and beads 114 may be at seven inches from bead 112. If leaf 24 is twelve inches and is retained under compression by beads 106 and beads 112, where the distance between beads 106 and beads 112 is nine inches, the length of leaf 24 is compressed by approximately three inches. This compression imparts a tension into wire 60.

To assemble lamp 10, leaf 20 is inserted into cutout 16 of base 12 as seen in FIG. 6 and FIG. 2. Two wires 60 are placed through aperture 18 and fixed to base 12 so that leaf 20 will be placed in compression by one quarter of the length of leaf 20. This is achieved by pre-positioning bead 104 (FIG. 2) at the distance described above. With leaf 20 in cutout 16, leaf 20 is compressed so that slots 26 may be placed around wires 60 at a position that is below beads 104. This is best seen in FIG. 4.

With leaf 20 positioned around wires 60 and compressed at a position that is below beads 104, leaf 20 pushes on beads 104 so as to maintain wire 60 in tension. With wire 60 in tension and leaf 20 in compression, lamp 10 stands erect. With wire 60 in tension, light source 40 is clipped onto wires 60. As shown in FIG. 2, light emanating from light source 60 may be directed into leaf 20 so that leaf 20 acts as a light deflector. Light source 60 may be directed towards other directions as well.

In a second embodiment of the invention, lamp 10 may be built upon so as to increase the height of lamp 10. To build upon lamp 10, leaf 22 is compressed between beads 102 and beads 108. Similar to leaf 20, the compression of leaf 22 maintains wire 60 between beads 102 and beads 108 in tension. To insure that lamp 10 stands erect, one end of leaf 22 must be inserted around a portion of wire 60 that is in tension from leaf 20. With leaf 22 in place, another light source 40 may be clipped to lamp 10.

Similar to leaf 20 and leaf 22, leaf 24 is compressed and placed into position between two sets of beads. As seen in FIG. 2, leaf 24 is placed into position between beads 106 and beads 112. This maintains tension on wire 60 as one leaf flows into the next leaf as illustrated by the arrows in FIG. 5.

With the addition of leaf 24, the height of lamp 10 has now increased by the three leaves so that a third light source 40 may be placed on wire 60. A fourth leaf may be placed between beads 110 and beads 114. Alternatively, beads 114 may serve to prevent wire 60 from fraying. With additional lengths of wire 60, more leaves and light sources may be stacked on top of lamp 10. In this way, light sources may be positioned in the vertical direction at any location the user chooses.

While the present invention has been particularly described with reference to the various figures, it should be understood that the figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the scope of the subject matter of the claimed invention.

What is claimed is:

1. A lamp support, comprising:

a base;

a wire coupled to the base, the wire having at least one bead coupled to the wire at a location above the base;

a leaf coupled between the base and the at least one bead so as to maintain the wire in tension; and a light source coupled to the wire between the at least one bead and base.

2. The lamp support of claim 1, wherein the leaf is coupled in compression between the base and the at least one bead.

3. The lamp support of claim 2, wherein the wire is a flexible wire.

4. The lamp support of claim 1, wherein the wire includes two wires, each of the two wires having a bead, each bead is formed from a solder drop weld.

5. The lamp support of claim 4, wherein the leaf is defined by an oblong shape, the leaf having a first end and a second end, and wherein each end of the leaf includes two slots.

6. The lamp support of claim 1, wherein the light source is coupled to a power source.

7. The lamp support of claim 6, wherein the light source emanates light and wherein the light is directed against the leaf.

8. An interleaved illumination support, comprising:

a base;

a wire coupled to the base, the wire having a plurality of beads coupled along the wire, the plurality of beads including a first bead coupled to the wire near the base, a second bead coupled to the wire above the first bead, and a fourth bead coupled to the wire above the second bead;

a first leaf coupled between the base and a second bead so as to maintain the wire in tension;

a second leaf coupled between the first bead and the fourth bead so as to maintain the wire in tension; and a first light source coupled to the wire.

9. The interleaved illumination support of claim 8, the plurality of beads further including a third bead coupled to the wire between the second and fourth bead, and a fifth bead coupled above the fourth bead, the interleaved illumination support further comprising:

a third leaf coupled between the third bead and the fifth bead.

10. The interleaved illumination support of claim 9, where the wire includes two wires coupled to a power source and wherein the first light source is coupled to the wire between the first bead and the base, the interleaved illumination support further comprising:

a second light source coupled to the wire between the second bead and the third bead; and a third light source coupled between the fourth bead and the fifth bead.

11. The interleaved illumination support of claim 10, wherein each leaf is coupled to the wire in compression.

12. The interleaved illumination support of claim 11, wherein the wire is a flexible wire.

13. The interleaved illumination support of claim 12, wherein each bead is formed from a solder drop weld.

14. The interleaved illumination support of claim 13, wherein each leaf is defined by an oblong shape, each leaf having a first end and a second end, and wherein each end of each leaf includes two slots.

* * * * *